United States Patent [19]

Dojel

[11] Patent Number: 4,705,301

[45] Date of Patent: Nov. 10, 1987

[54] ENTRANCE TICKET

[76] Inventor: Bernhard Dojel, Sulenstrasse 37, D-4240 Emmerich 5, Fed. Rep. of Germany

[21] Appl. No.: 805,712

[22] Filed: Dec. 6, 1985

[30] Foreign Application Priority Data

Dec. 7, 1984 [DE] Fed. Rep. of Germany ..... 8435844

[51] Int. Cl.[4] ..... B42D 15/00; B41L 5/00

[52] U.S. Cl. ..... 283/105; 283/903; 282/17

[58] Field of Search ..... 283/100, 103, 105, 106, 283/1 R, 2, 98, 901, 903; 282/13, 17; 40/124.1, 124.2, 124.4, 158, 159; 446/79, 147; D19/20, 21, 22, 23, 24, 25

[56] References Cited

U.S. PATENT DOCUMENTS

| | | | |
|---|---|---|---|
| 2,812,957 | 11/1957 | Sarlund | 283/105 |
| 2,831,278 | 4/1958 | Myers | 283/2 |
| 3,290,812 | 12/1966 | Hankins | 283/2 |
| 3,900,219 | 8/1975 | D'Amato et al. | 283/105 |
| 3,930,673 | 1/1976 | Sanden | 283/903 |
| 4,033,611 | 7/1977 | Johnsen | 283/105 |
| 4,320,158 | 3/1982 | Seeley | 283/105 |

FOREIGN PATENT DOCUMENTS

| | | | |
|---|---|---|---|
| 654529 | 2/1986 | Switzerland | 283/903 |

*Primary Examiner*—Kazenske E. R.
*Assistant Examiner*—Paul M. Heyrana, Sr.
*Attorney, Agent, or Firm*—Thomas J. Greer, Jr.

[57] ABSTRACT

An entrance ticket comprises a flexible rectangular print carrier made of paper and comprising two similar flexible layers connected together permanently over their peripheral regions, of which the one layer has in its central region portions which can be folded back away from the other layer so that additional surfaces are available for advertising and/or other information.

3 Claims, 2 Drawing Figures

FIG.1
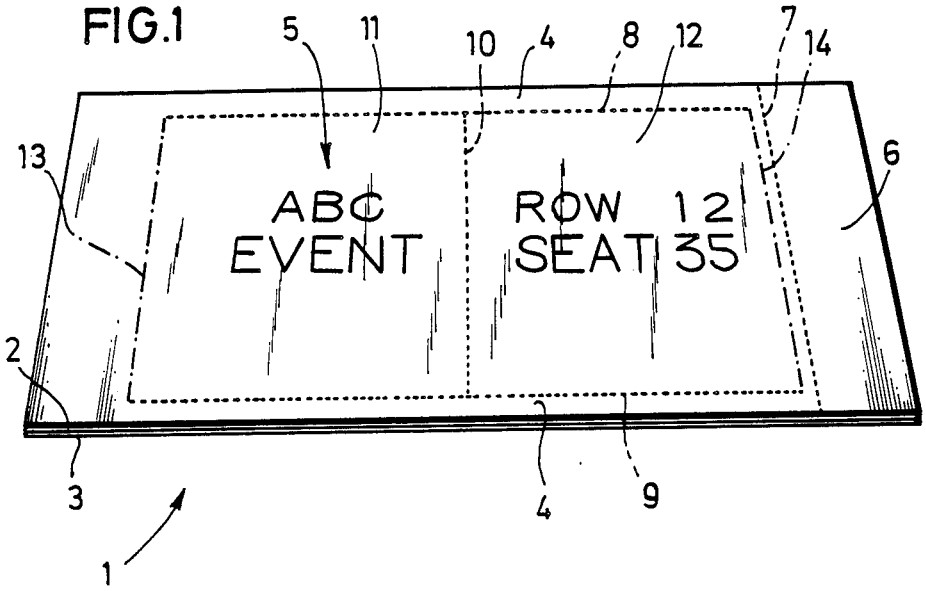
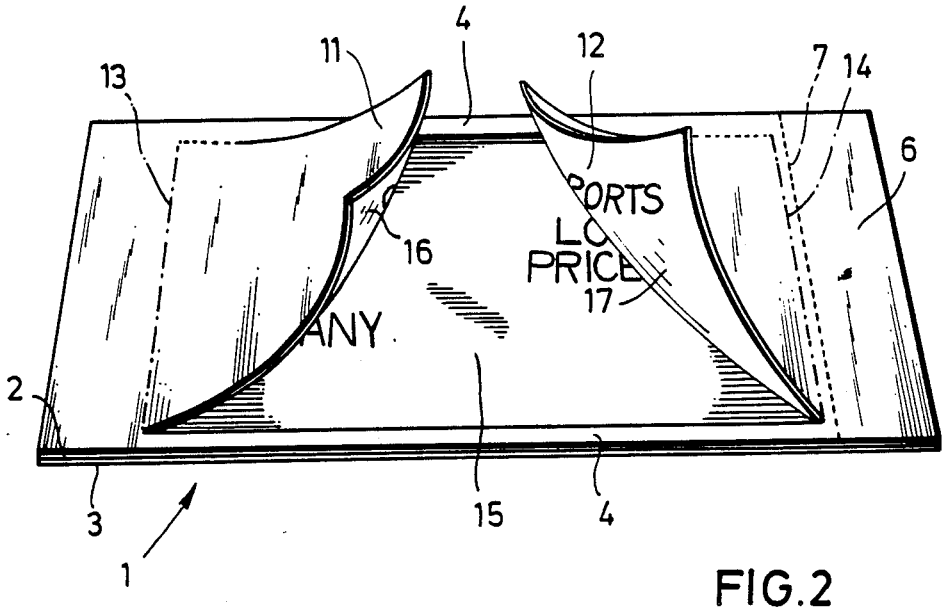
FIG.2

ENTRANCE TICKET

The invention relates to an entrance ticket or similar card in the form of a flexible rectangular print carrier made of paper or the like.

Entrance tickets usually comprise a rectangular piece or more or less stiff but flexible paper. They are provided on the front face with a printed impression which identifies the institution to which the ticket gives access, and the indication of the seat or standing place. The back of the ticket, not needed for information concerning entry, can be employed for advertising.

It has been found that the known entrance tickets have only limited suitability for the application of advertisements or other information going beyond the actual purpose of the entrance ticket, simply because the actual back face which is alone available is not big enough. The owner of the institution is not only interested in obtaining additional income through entrance tickets used to carry advertising but would often like to transmit to the participants information also about future games or about the already-known fixture list, without having to have to prepare and distribute additional printed material such as information leaflets.

The object of the invention is to provide an entrance ticket or access card which has additional space for incorporating advertising or other information going beyond the requirements concerning the institution in question to which the ticket gives access, without having to enlarge the ticket itself.

This object is achieved according to the invention in that the flexible print carrier forming the entrance ticket or access card is made up of two similar flexible layers, preferably of paper, permanently secured together in their peripheral zones, of which the one layer has in its central region portions which can be folded back away from the other layer. In other words the ticket according to the invention is made up of two paper layers which are only connected together in the peripheral region or edge zone, whilst in the central zone of the ticket they can simply lie against one another and accordingly be separated from one another. The one layer, preferably the upper layer, has portions which can be folded back away from the other layer or underlayer, so that part of the upper surface of the lower layer can be exposed. This part of the lower layer can therefore be used as an additional surface receiving printed matter as the advertising material or other information applied to it can be made visible by folding back the portions of the upper layer. The inner faces of the folding-back portions of the upper layer can likewise be employed to carry advertising and/or other information. Thereby the size of the surface of the ticket which is available for advertising and other information is, according to the invention, almost doubled in area so that the card is suitable as a particularly advantageous and convenient carrier of advertising without the advertising or other information applied to it being capable of interfering with the legibility of the information necessary for the institution to which the ticket gives access.

The somewhat increased manufacturing costs of the ticket according to the invention are more than offset by the increased value of the information provided and in particular by the additional advertising revenue.

According to one practical embodiment of the invention the folding-back portions of the one layer of the ticket are connected to the associated layer in a manner whereby they are hinged about lines extending parallel to the ends of the ticket, i.e. the folding-back portions remain connected to the ticket so that the information and/or advertising present on them cannot become lost by the user of the ticket.

Preferably the folding-back portions of the one layer are connected detachably to the associated layer by lines of perforations extending parallel to the longitudinal edges of the ticket and detachably connected to one another by a further line of perforations extending perpendicular to those edges. The ticket according to the invention thus comprises initially two unbroken layers stuck together around their peripheral regions. Only after the ticket in question has been sold does the purchaser of the ticket release and fold back the folding-back portions along the lines of perforations in order to render visible the information and/or advertising present underneath. Therefore the ticket according to the invention can be sold in the form of blocks in the usual way without the folding-back portions representing any hindrance.

The peripheral region along which the two flexible layers are stuck together clear of the folding-back portions can be kept very small so that an optimally large area of the lower layer and of the inner faces of the folding-back portions is available.

According to a further feature of the invention the ticket has in its peripheral region at one end a detachable portion defined by a line of perforations and able to be torn off for cancelling the ticket. This portion is present in that region of the ticket in which the two layers are stuck together, i.e. even after this portion has been torn off the two layers of the ticket are stuck together all the way round and so the ticket is not damaged by the removal of the cancelling portion.

By virtue of the invention there is provided a novel entrance or access ticket which, in a simple manner, has additional surfaces for further information and/or advertising. These additional surfaces are visible when parts of the ticket are folded back, which step is undertaken by the purchaser when the ticket has been sold.

An embodiment of an entrance ticket according to the invention is illustrated diagrammatically by way of example in the drawing, in which:

FIG. 1 is a perspective view of the ticket and

FIG. 2 is a view like that of FIG. 1 but in which two rectangular portions present in the upper layer of the two-layer entrance ticket have been released and partially folded back.

The entrance ticket 1 illustrated in the drawing comprises two superimposed layers 2 and 3 of rectangular outline in plan view and made of flexible material such as paper. These two layers 2 and 3 are stuck together with adhesive along a circumferentially extending peripheral region 4 whilst they lie freely in contact with one another over a central region 5 and accordingly can be separated from one another in this region.

At the right hand end of the ticket 1 as shown in the drawing there is a strip-shaped portion 6 over which the two layers 2 and 3 are stuck together and which can be separated from the ticket along a line of perforations 7.

The upper layer 2 contains two lines of perforations 8 and 9 extending parallel to one another in a longitudinal direction and lying within the stuck-together peripheral region 4; the lines 8 and 9 are joined together by a further line of perforations 10 present approximately in the middle of the ticket 1 and extending transversely. These lines of perforations 8, 9 and 10 can be torn open so that two folding-back portions 11 and 12 of the upper layer 2 can be folded back along crease lines 13 and 14 which interconnect the ends of the lines of perforations 8 and 9. The portions 11 and 12 therefore, even when they have been folded back, remain attached to the upper layer 2 of the ticket 1.

By the lifting of the portions 11 and 12 additional surfaces 15, 16 and 17 on the upper face of the lower layer 3 and on the inner faces of the portions 11 and 12 are uncovered and these are available for the printing of advertising and/or other information. In this way the total information content of the ticket 1 is significantly increased.

I claim:

1. An entrance ticket comprising a rectangular, flexible print-carrier made of paper-like material, and having ends and side edges, said print carrier comprising upper and lower flexible layers of similar outline having central and peripheral regions and connected together permanently in the peripheral regions thereof, and said upper layer carrying ticket indicia and having in the central region thereof two foldable-back portions, said portions being detachably connected to one another along a central line of performations extending perpendicular to said side edges, said foldable-back portions being each connected to said upper layer in a hinged manner along a respective crease hinge line extending parallel to said ends of the ticket, said foldable-back portions being each connected detachably to said upper layers by lines of perforations extending parallel to said side edges of the ticket, the lower surface of each of the two foldable-back portions and the upper surface of the lower layer beneath the two foldable-back portions carrying indicia such as advertising or other information, whereby the two foldable-back portions may be folded back in diametrically opposite directions, with at least one portion being folded back away from said second layer.

2. The ticket set forth in claim 1, wherein said first and second flexible layers are connected together adhesively over said peripheral regions, clear of said foldable-back portions.

3. The ticket set forth in claim 1, further comprising a portion at one end thereof and in an end peripheral region of said layers, which portion includes a line of perforations and can be torn away.

* * * * *